US006006743A

United States Patent [19]

Shimek et al.

[11] Patent Number: 6,006,743

[45] Date of Patent: Dec. 28, 1999

[54] INDOOR-OUTDOOR PORTABLE GAS BURNER

[75] Inventors: Ronald John Shimek, Prior Lake; Daniel Curtis Shimek, Apple Valley; David Charles Lyons, Redwing; Robb Edward Bennett, Jordan, all of Minn.

[73] Assignee: Heat-N-Glo Fireplace Products, Inc., Lakeville, Minn.

[21] Appl. No.: 09/024,284

[22] Filed: Feb. 17, 1998

[51] Int. Cl.[6] ..... F24C 3/00; F23D 14/10

[52] U.S. Cl. ..... 126/512; 126/40; 126/59; 431/125

[58] Field of Search ..... 126/41 R, 38, 126/512, 9 R, 11, 40, 59; 431/125; D7/402

[56] References Cited

U.S. PATENT DOCUMENTS

| | | | |
|---|---|---|---|
| D. 324,153 | 2/1992 | Wood | D7/402 |
| 2,745,480 | 5/1956 | Crone | 158/113 |
| 3,416,733 | 12/1968 | Leighton | 239/407 |
| 3,947,229 | 3/1976 | Richter | 431/125 |
| 3,976,046 | 8/1976 | Morton et al. | 126/9 R |
| 3,987,779 | 10/1976 | Richardson | 126/165 |
| 4,267,816 | 5/1981 | Koziol | 126/41 R |
| 4,726,349 | 2/1988 | Gehrke | 126/25 R |
| 4,726,351 | 2/1988 | Whittaker et al. | 126/127 |
| 4,762,530 | 8/1988 | Koziol | 48/180 |
| 4,838,241 | 6/1989 | Rieger | 126/92 R |
| 4,869,664 | 9/1989 | Wright et al. | 431/328 |
| 5,033,454 | 7/1991 | Smith | 126/512 |
| 5,391,074 | 2/1995 | Meeker | 431/6 |
| 5,499,576 | 3/1996 | Grunder | 99/421 H |
| 5,553,603 | 9/1996 | Barudi et al. | 126/512 |
| 5,601,073 | 2/1997 | Shimek | 126/512 |
| 5,623,988 | 4/1997 | Holowczak | 165/134.1 |
| 5,702,120 | 12/1997 | Malofsky et al. | 280/642 |
| 5,711,663 | 1/1998 | Giebel et al. | 431/354 |

FOREIGN PATENT DOCUMENTS

| | | | |
|---|---|---|---|
| 2182131 | 5/1987 | United Kingdom | F23D 14/10 |
| 2182431 | 5/1987 | United Kingdom | F24C 3/04 |

*Primary Examiner*—Ira S. Lazarus
*Assistant Examiner*—Donna Mann
*Attorney, Agent, or Firm*—John B. Sowell-ATY

[57] ABSTRACT

A portable gas burner which is usable in remote areas without electricity is provided for use as a fire place burner, or as a camp fire burner or as a stove burner or as a grill burner. The novel gas burner comprises a base unit onto which is mounted a hollow ceramic fiber top which is connected to the base unit so as to form a gas manifold therebetween for receiving a mixture of gas and air. A manually operable gas valve means in said base unit is connected to a gas supply. The valve when opened allows a mixture of gas and air to flow through a gas line into the gas manifold until such time as a temperature thermocouple sensing element is heated sufficiently to hold manually operable gas valve open.

18 Claims, 9 Drawing Sheets

INDOOR-OUTDOOR PORTABLE GAS BURNER

BACKGROUND OF THE INVENTION

1. Field of the Invention

The present invention relates to efficient gas burners for burning natural gas and propane gaseous fuels. More particularly, the present invention relates to a novel gas burner system that may be used in fireplaces and/or camp fires and is portable to accomplish dual purposes.

2. Description of the Prior Art

Gas burners are classified in U.S. Class 126, sub-classes 91, 92R, 125, 126 and 512. In our U.S. Pat. No. 5,601,073 there is disclosed and claimed a flat pan burner having a U-shaped base pan which is connected to a formed top layer. The burner in this patent was designed for and has been used in gas fireplaces.

In our co-pending U.S. application Ser. No. 08/705,845 filed Sep. 27, 1996, there is shown and described hollow log burners of the type manufactured for use in artificial log camp fires. This latter burner system includes light-weight reinforced ceramic fiber (RCF) logs which have hollow passageways as well as burner jets for producing gas flames emitted from the logs and is incorporated by reference herein. Such gas log units have been used in remote areas where natural gas is not available, thus, require that tanks of propane be provided and that the units can be disassembled and assembled at the camp site if stored in a disassembled or partially assembled condition. Such units are not usable as a grill or as a gas burner system for a gas fireplace, thus, are single purpose fireplace units. Our U.S. Pat. No. 5,688,568 issued Nov. 18, 1997 also shows and describes moulded lightweight insulating reinforced ceramic fiber (RCF) fireplace elements using materials of the type used herein.

It would be desirable to provide a novel dual purpose gas burner which may be used in a fireplace as a burner or on a deck as a campfire or a grill and/or as a portable and storable campfire-grill that may be set into operation by removing a storage cover and connecting a gas line to the burner unit.

SUMMARY OF THE INVENTION

It is a primary object of the present invention to provide an outdoor-indoor portable gas burner which is usable in fireplaces, on decks, in remote areas as a fireplace burner or as a campfire or grill.

It is another primary object of the present invention to provide a gas burner that may be mounted on and carried in a novel decorative covered unit.

It is another primary object of the present invention to provide a gas burner which may be set up and started immediately at a remote camp site as a heating unit or a stove or grill.

It is another primary object of the present invention to provide a gas burner which serves as a stove or heating unit in a cabin or house in a remote area where no natural gas is available.

It is another principal object of the present invention to provide a camp fire or stove cooking unit for use inside or outside of a living area.

It is another general object of the present invention to provide a novel gas burner-campfire-stove which may be set in operation immediately by plugging into a snap connector of a gas line and starting the burner. Conversely the unit can be unplugged from the gas line and replaced in a cover for storage.

According to these and other objects of the present invention, there is provided a portable gas burner for fireplaces and campfires which comprises a base unit and a top ceramic fiber unit connected to form a gas manifold therebetween. The gas manifold has a gas line connection for connecting a mixture of gas and air to the gas manifold. The novel gas burner unit is provided with a three dimensional contoured surface in the ceramic fiber top and a pattern of burner jets extend through the ceramic fiber top into the gas manifold for creating a desired gas flame pattern. The novel gas burner unit is ready to operate when plugged to a gas supply line and is ready to be stored when unplugged and covered with a novel molded or formed cover which preferably has a decorative look and serves a dual purpose for covering a propane tank.

DESCRIPTION OF THE PREFERRED EMBODIMENTS

Figure 1:
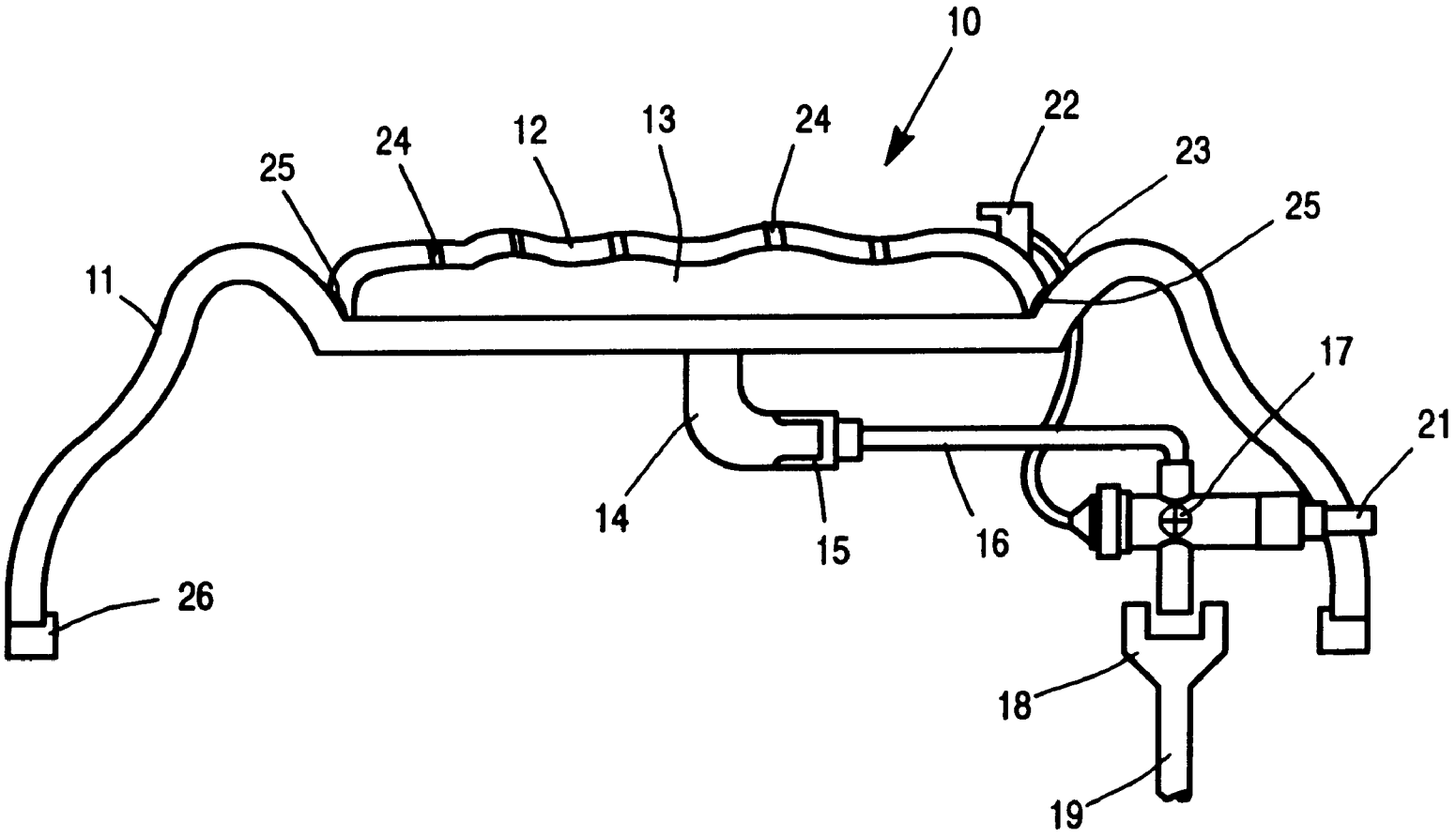
FIG. 1 is a diagrammatic drawing in partial section showing a preferred embodiment indoor-outdoor portable gas burner.

Refer now to FIG. 1 showing a diagrammatic drawing in partial section of a preferred indoor-outdoor portable gas burner 10. Gas burner 10 comprises a base unit 11 preferably made from a thermoset plastic to provide a decorative unit which appears to be either a mound of coals or rocks surrounding a campfire. A ceramic fiber top 12 is fixed to the base unit 11 to provide a hollow manifold 13 therebetween which is adapted to receive a mixture of gas and air via the supply gas pipe 14. The gas pipe 14 is shown having an air shutter valve 15 which provides a mixture of gas from gas pipe 16 to pipe 14. The gas pipe 16 is shown connected to a manually operable gas valve 17 which is provided with a quick connection for accepting a connector 18 from a gas line 19 which may be connected to either a propane tank or a source of natural gas. The gas valve 17 is shown coupled to a thermocouple 22 which has an actuating line 23 connected to the valve 17. In the preferred mode of operation for starting the burner 10, a plunger 21 is manually operated to supply gas to the manifold 13. The gas exits through burner jets 24 and when ignited will heat the thermocouple 22 which in turn will maintain the valve 17 open. The light weight reinforced ceramic fiber (RCF) top 12 is preferably permanently attached to the base unit 11 by a high temperature silicon adhesive 25.

In the preferred embodiment of the present invention, the base unit 11 is provided with legs 26 which stand off from their support structure to permit air to enter into the hollow shell of base 11 and be mixed by the air shutter valve 15.

Figure 2:
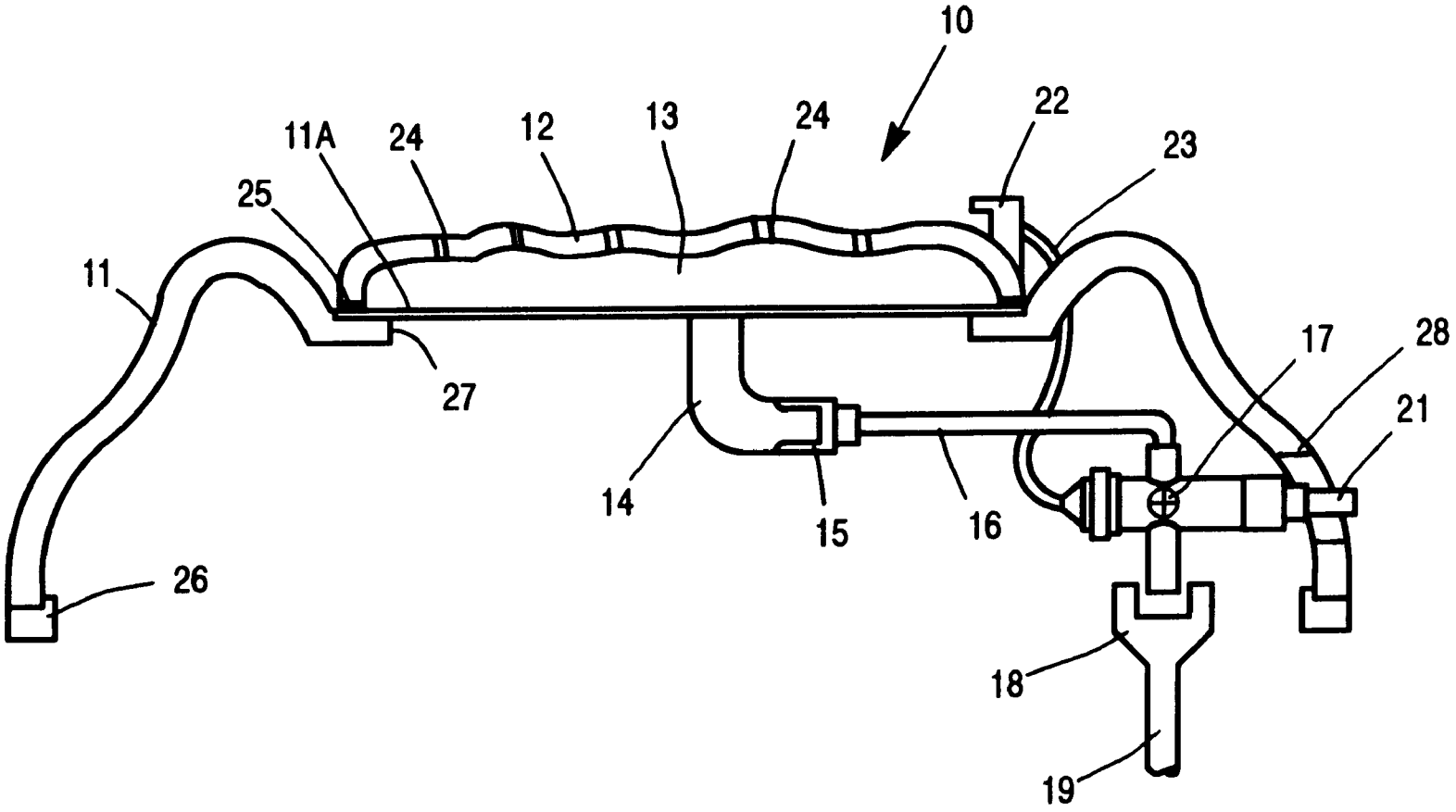
FIG. 2 is a diagrammatic drawing in partial section showing a modified embodiment of the indoor-outdoor gas burner of FIG. 1.

Refer now to FIG. 2 showing a diagrammatic drawing in partial section of a modified embodiment gas burner which is substantially identical to the gas burner shown in FIG. 1 and uses identical numerals for the same elements as explained hereinbefore. The modified base unit 11 comprises a second element 11A in the form of a plate which connects to the ceramic fiber top 12 and is removably attached by screws (not shown) to the base unit so that the gas burner system 10 may be used separate and apart from the base unit 11. For purposes of disconnecting the burner 10 from the base unit 11, there is provided a large central aperture 27 in the base unit 11 for receiving the burner and gas valve structure through the aperture 27. The plate 11A is free to be detached and removed from the base unit 11. In this embodiment the plunger 21 is provided in an opening 28 of base 11 which permits the unit 10 to be completely disconnected and removed from the decorative base 11.

Figure 3:
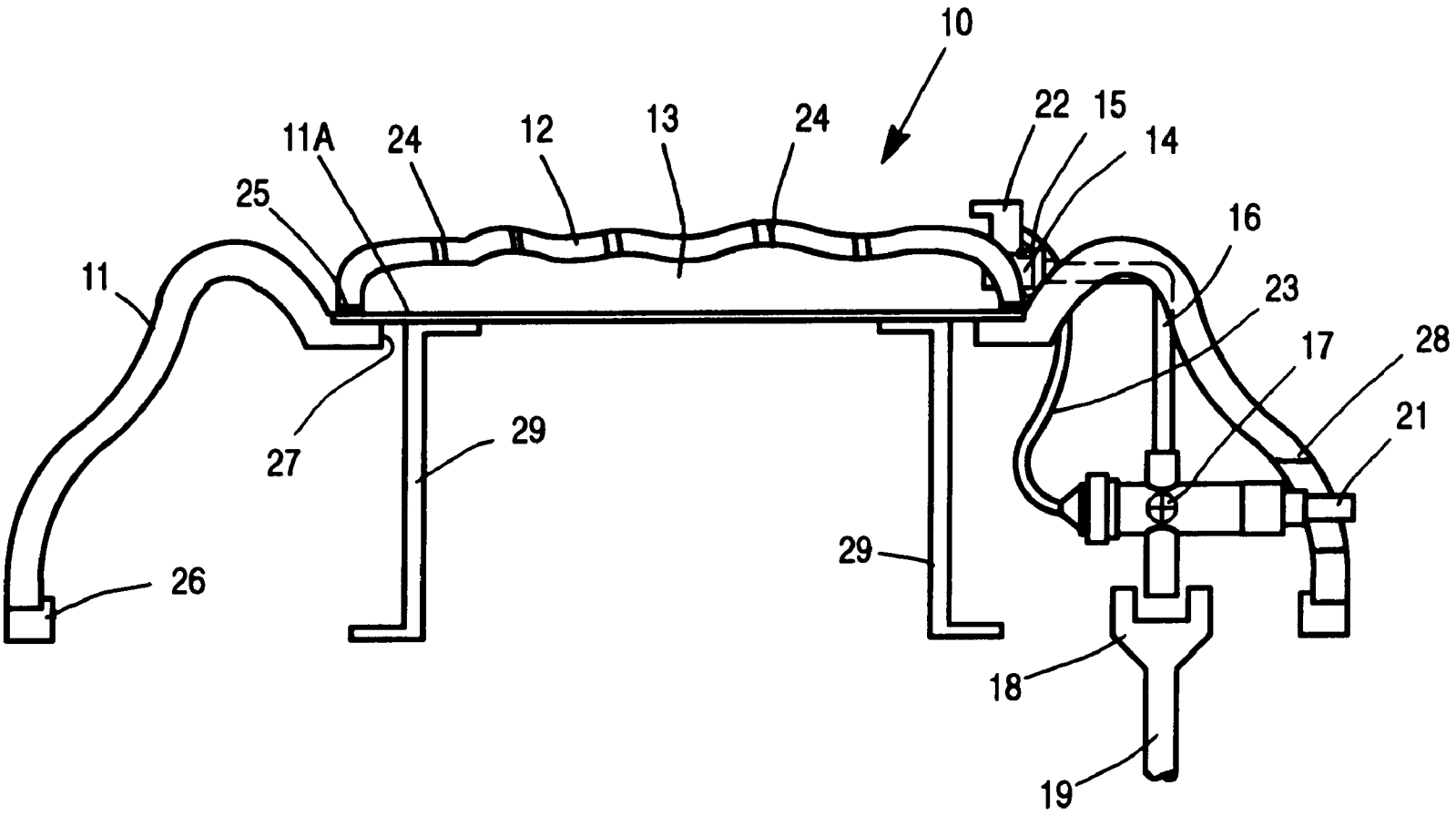
FIG. 3 is a diagrammatic drawing in partial section of a modified embodiment showing another novel removable gas burner.

Refer now to FIG. 3 showing a diagrammatic drawing in partial section of a modified embodiment portable and replaceable removable gas burner unit.

The burner shown in FIG. 3 is substantially identical to that shown in FIGS. 1 and 2 except that gas pipe 14 and air shutter valve 15 are built into the ceramic fiber top 12. The elements in FIG. 3 which are the same as those in FIGS. 1 and 2 are numbered the same and do not require additional explanation. There is further shown a pair of leg extensions 29 which may also serve as a mounting structure for the manual valve 17. When the burner unit 10 is removed from the base unit 11, the burner unit assembly may be placed on its legs 29 in an open space on a deck or in a fireplace or on the ground where no flammable material is present. It will be understood that the unit shown in FIGS. 2 and 3 are substantially identical in their mode of operation and the legs shown in FIG. 3 may also be provided and connected to the plate 11A shown in FIG. 2.

Figure 4:
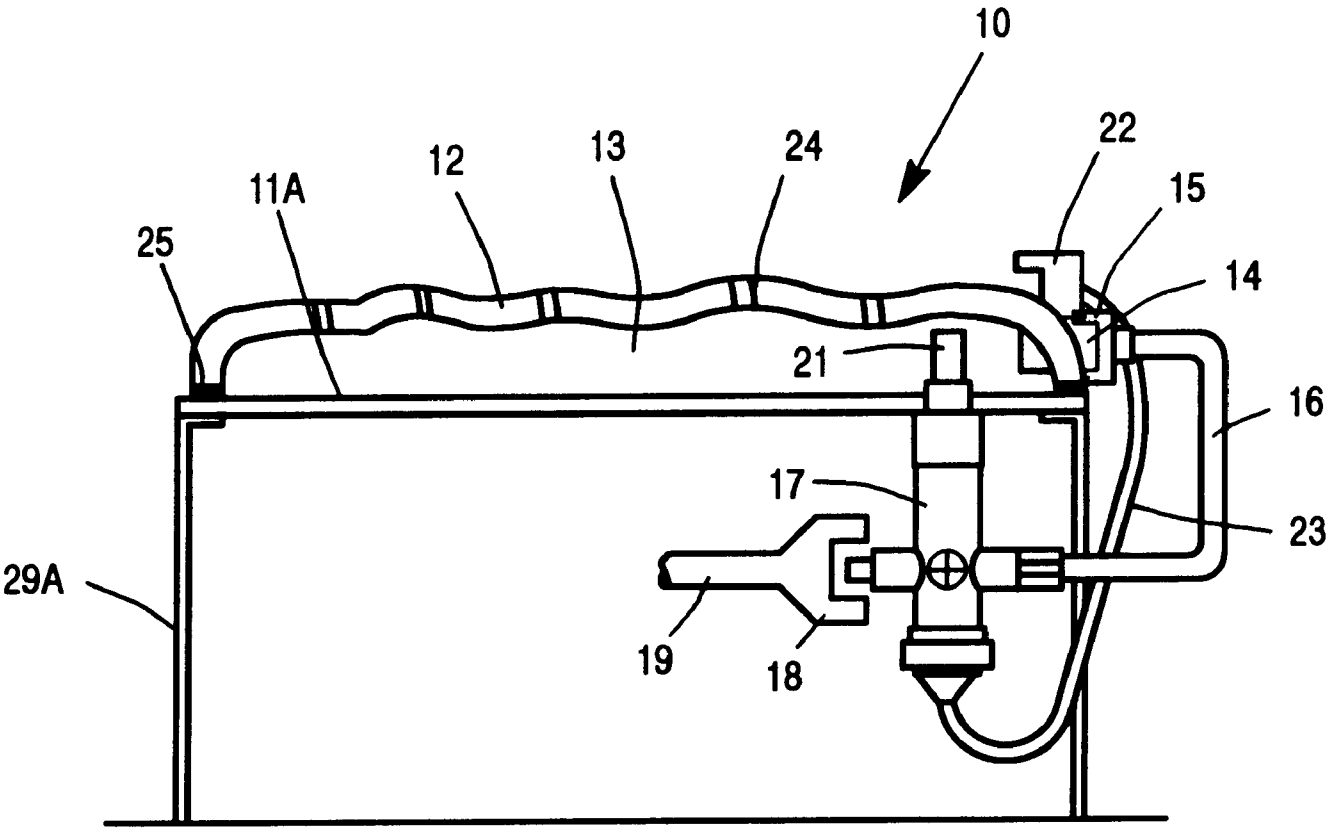
FIG. 4 is a diagrammatic in partial section of a modified transportable gas burner.

Refer now to FIG. 4 showing a diagrammatic 20 drawing in partial section of a modified embodiment transportable gas burner designed for being built into a custom system for a deck, patio or yard. The safety valve 17 is shown mounted through and supported by an extended edge of the burner base plate 11A. The leg extensions 29 and the base unit 11 are replaced by a cylindrical metal support 29A which is sufficiently strong to protect the valve 17 and gas line 19 and the thermocouple activating line 23. In this preferred embodiment, the burner 10 is surrounded on the sides with rocks or other non combustible material to provide a built in or custom unit 10. When left in the open a cover (not shown) is placed over the unit to protect it from the weather.

Figure 5:
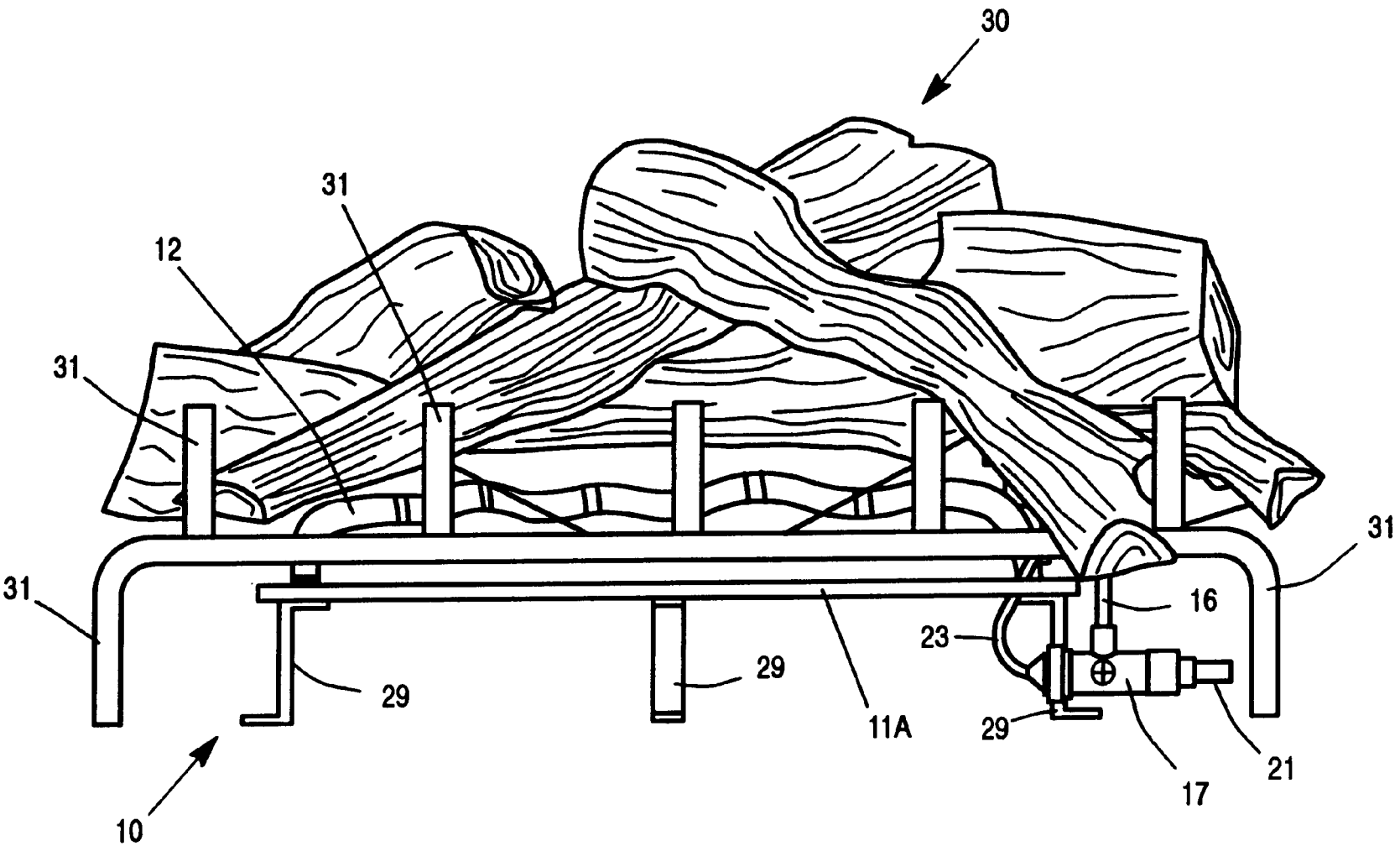
FIG. 5 is a schematic and front elevation of a gas burner of the type shown in FIGS. 2 and 3 when placed under a set of artificial logs that are placed on a grate in a fireplace.

Refer now to FIG. 5 showing a schematic drawing in front elevation of a gas burner 10 of the type shown in FIGS. 2 and 3 which is placed under a set of artificial logs 30 which in turn are placed onto a grate 31, preferably located in a conventional fireplace or in a fabricated fireplace unit. The numerals used on the gas burner unit are the same as those in shown in FIGS. 2 and 3 and do not require further explanation. It will be understood and appreciated that this particular burner may be placed in a masonry fireplace where a grate used for burning wood is located. If the wood burning grate is not supplied with sufficient clearance, then the grate 31 may be substituted therefor and used for burning wood when the gas fireplace log set 30 is removed. In a typical scenario, most rustic cabins in the great outdoors do not have any natural gas or electricity readily available. Thus, when arriving at a cabin in a remote area, it is possible to set up the fireplace burner unit 10 shown in FIG. 5 and rapidly heat the interior of the cabin. Going one step further, it is also possible to use the fireplace burner under the grate 31 and put a grill support, which will be explained in detail hereinafter, over the burner unit 10 and use it as a stove or grill. At some subsequent time, it is possible to remove the portable gas burner 10 and set up a wood burning fireplace in the same area.

Figure 6:
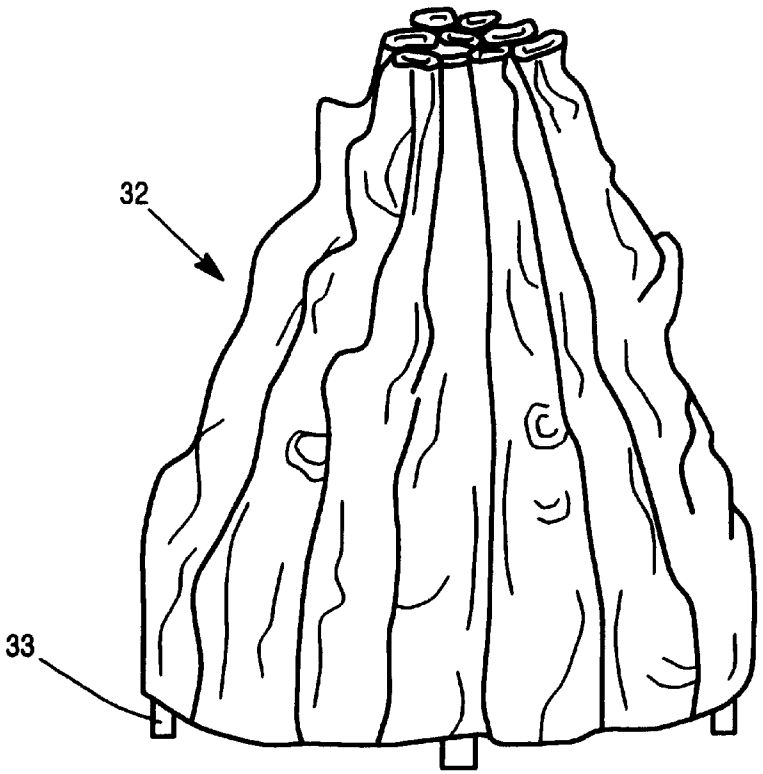
FIG. 6 is an elevation view of a decorative cover which fits over the gas burners shown in FIGS. 1 and 3 and forms a portable storage carrier unit.

Refer now to FIG. 6 showing an elevation view of a decorative cover 32 for the burners shown in FIGS. 1 to 5. The cover also forms a portable storage carrier. In the preferred embodiment of the present invention, the molded cover is formed using conventional well known plastic forming and moulding techniques and colored to resemble a campfire comprising a plurality of stacked logs. Further, the cover 32 is provided with legs 33 which are used as a standoff when the cover 32 is placed over a propane tank.

Figure 7:
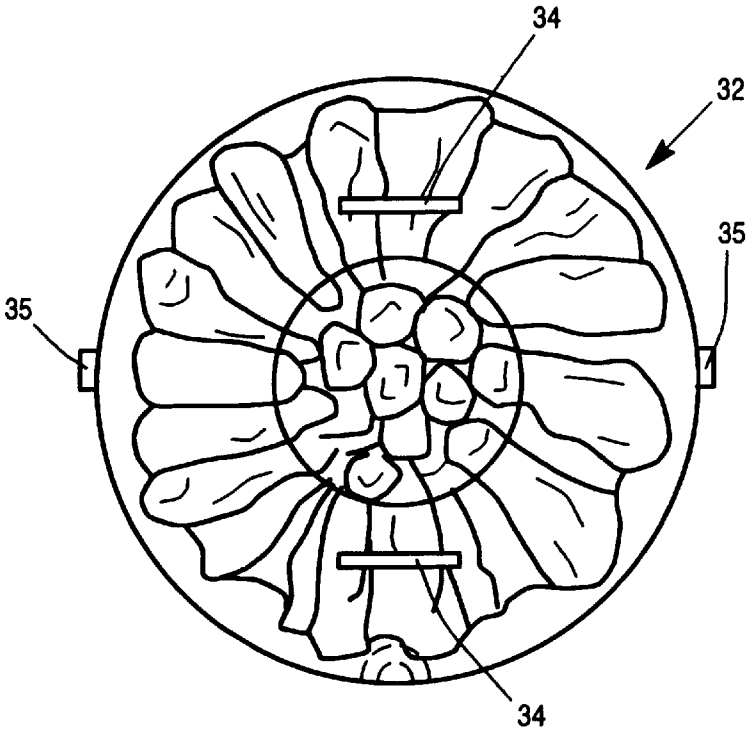
FIG. 7 is a top view of the cover shown in FIG. 5 showing additional features which make it useful as a cover for a propane tank.

Refer now to FIG. 7 showing a top view of the decorative cover 32 in FIG. 6 showing additional features which are useful when used as a propane tank cover. The vent slots 34 are also arranged as hand holds which extend outward from the cover 32 to prevent water from entering into the fireplace unit when it is in its storage condition. Further, there are shown a pair of buckle draw latches 35 which are permanently mounted on the decorative cover 32 and adapted to snap under the edge of the burner unit and are also used on the next to be described grill support unit.

Figure 8:
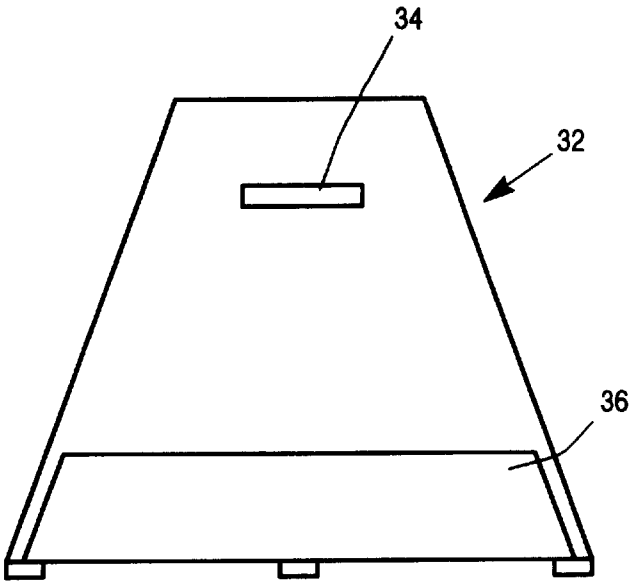
FIG. 8 is a side view of a grill support which stores inside of the decorative cover and is adapted to support conventional grids and stove top items for cooking.

Refer now to FIG. 8 showing a grill support unit 36 which nests or fits inside of, and stores in, the decorative cover 32. The grill or stove support 36 is adapted to support the conventional grill elements which are found in outdoor grills. The grill support will also support a stove top item for cooking or serve as a stand-off for other types of cooking units which will be explained in greater detail hereinafter.

Figure 9:
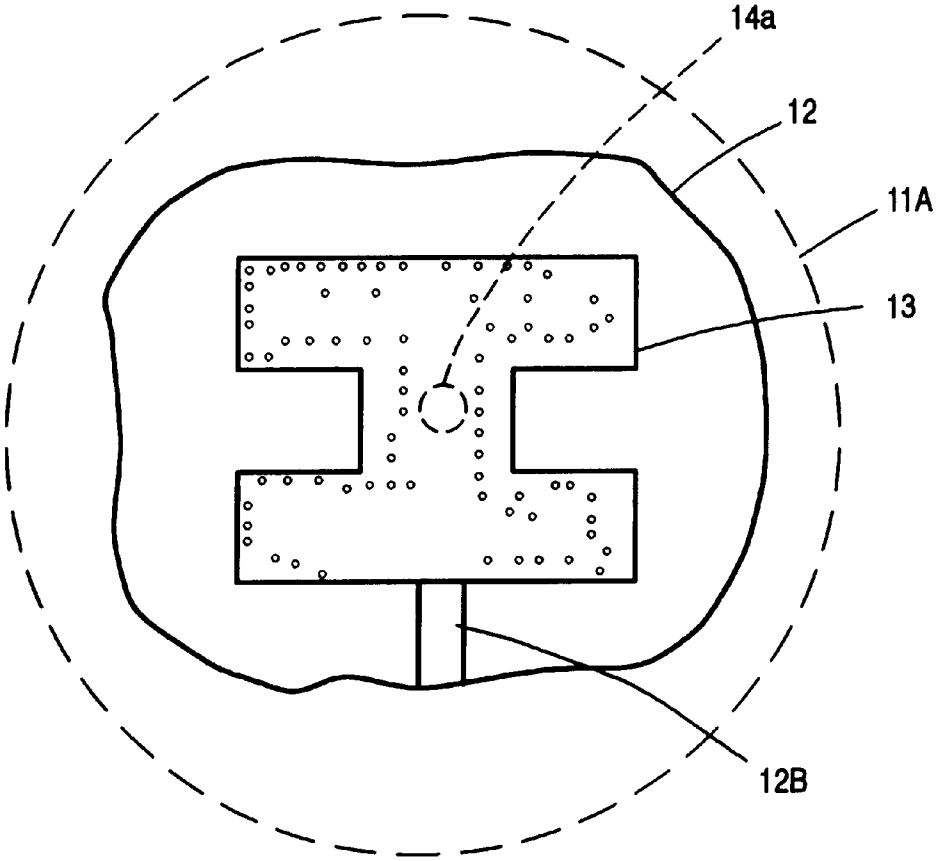
FIG. 9 is a detailed plan view looking at the bottom of a hollow ceramic fiber top unit showing a pattern of burner jets and the supporting structure which surrounds the gas manifold area.

Refer now to FIG. 9 showing in detail a plan view looking at the bottom of a hollow ceramic fiber top 12 and showing a pattern of burner jets and supporting structure which surrounds the H-shaped gas manifold area 13. Note that the outer perimeter of the ceramic fiber top 12 need not be circular in shape. The base unit 11A shown in phantom lines mounts to the bottom of unit 12 may be circular. The jet pattern for any particular gas system or burner unit may have different size jets for producing more efficient burning. Tests have shown that some patterns of holes and sizes are more efficient than others. There is also shown in phantom lines a hole 14A which is adapted to receive the gas pipe 14. Further, there is shown a recessed passageway 12B which is adapted to receive a gas pipe when mounted in a horizontal plane as shown in FIG. 3. It will be understood that the H-shaped area is recessed into the ceramic fiber top 12 and provides the aforementioned and described hollow manifold 13.

In the preferred embodiment of the present invention, a bead of adhesive is applied around the manifold area close to the outside parameter of the top unit 12 before it is attached to either the base unit 11A or a base unit 11. Preferably the same adhesive is used to seal around the gas pipe 14 when it is connected to the recessed area 12B.

Figure 10:
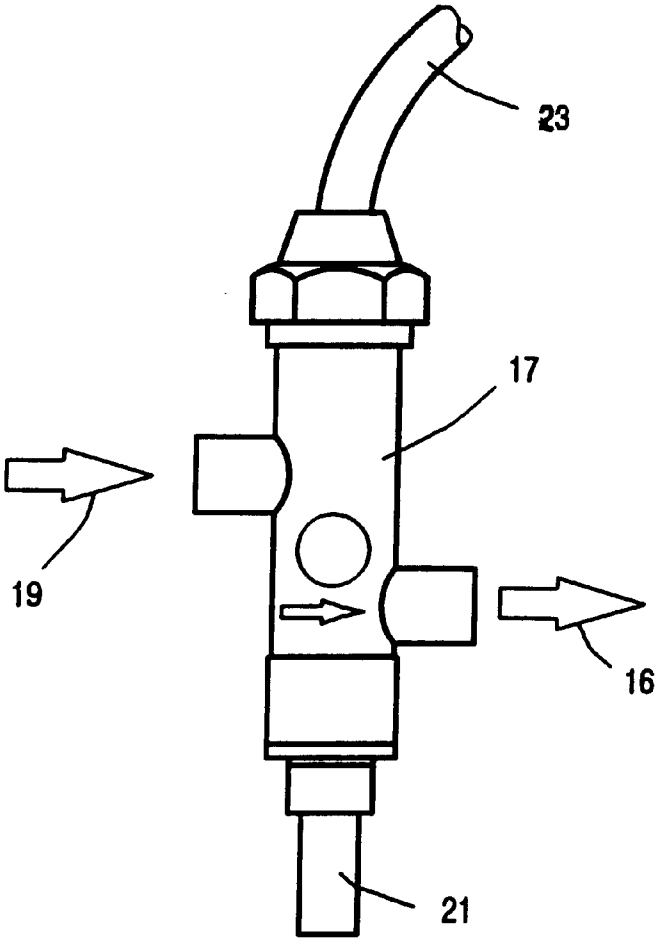
FIG. 10 is a detailed plan view of a typical manual operable gas valve which is preferably used on all portable gas burner units and systems.

Refer now to FIG. 10 showing a detail in plan view of a typical manually operable gas valve which is preferably used on all portable gas burner systems. The manually operated gas valve 17 shown is in a normally off condition before starting the gas burner. The gas line which is shown in FIG. 2 as item 19 is connected to the inlet side of the gas valve 17 and the outlet or supply side is shown by numeral 16 as the gas outlet line. In order to turn the normally closed gas valve on, the manually operated plunger 21 is depressed allowing gas from inlet line 19 to appear at the outlet 16. When the gas begins to burn in the gas burner 10, it heats the thermocouple 22 which in turn creates a signal on actuator line 23 which will hold the gas valve open, otherwise releasing the plunger 21 will again close the gas valve and prevent the gas from reaching the manifold 13.

Having explained a preferred embodiment burner and two modifications thereof it will be understood that the novel portable gas burner is in fact a grill and a stove and a fireplace burner as well as a camp fire and can serve all four purposes in the identical structural environment. Thus campers may take their burner system from their fireplace into their homes and take it with their campers and motor homes to a recreation site. Within a matter of minutes the burner can be set up for cooking and/or heating and/or grilling as the need may arise. While the gas burner system depicted in the present invention is an improvement over aforementioned prior art burners, it was particularly designed for and is capable of multiple functional uses whereas prior art gas burner systems were designed to have a single use.

What is claimed is:

1. A portable insulated gas burner for fireplaces and for campfires, comprising:

a) a base unit, b) a lightweight insulating reinforced ceramic fiber (RCF) top connected on top of said base unit forming a gas manifold therebetween and for receiving a mixture of gas and air, c) said ceramic fiber top having a three-dimensional contoured face, d) a pattern of burner jets extending through said insulating ceramic fiber top connecting into said gas manifold for creating an open gas burner for a desired free flame pattern, e) connecting means for connecting a gas supply line to said gas manifold, f) a primary air shutter valve connected to said gas supply line for adjusting the air gas mixture in said gas manifold, g) a manually operable gas valve for connection to a source of gas and having an outlet connectable to said gas supply line, and h) said portable insulating gas burner being quickly disconnectable from the source of gas for transport or storage.

2. A portable gas burner as set forth in claim 1 which further includes means for connecting and sealing said base unit to said ceramic fiber top.

3. A portable gas burner as set forth in claim 1 wherein said means for connecting and sealing said base unit to said insulating ceramic fiber top comprises a high temperature silicon base adhesive.

4. A portable gas burner as set forth in claim 1 wherein said manually operable gas valve is normally closed and which further includes a thermocouple operably connected to said manually operable gas valve for sensing the presence of a gas flame and opening said manual operable gas valve.

5. A portable gas burner as set forth in claim 4 which further includes snap connector means for connecting said source of gas to said manually operable gas valve.

6. A portable gas burner as set forth in claim 1 wherein said ceramic fiber top is formed as a bed of coals, and said base unit comprises a plastic shell shaped as a mound of coals or stones.

7. A portable gas burner as set forth in claim 6 wherein said base unit further comprises a flat plate connected to said ceramic fiber top to form said burner which is detachably mounted to said plastic shell for providing a removable burner.

8. A portable gas burner as set forth in claim 6 wherein said plastic shell comprises fiber glass reinforced thermoset plastic resin.

9. A portable gas burner as set forth in claim 6 which further includes a decorative cover detachably mounted over said plastic shell to form a storable cover for the gas burner and providing a decorative cover for burner equipment.

10. A portable gas burner as set forth in claim 9 wherein said decorative cover further comprises latch means for attaching said decorative cover to said gas burner.

11. A portable gas burner as set forth in claim 9 which further includes a truncated cone shaped grill support on said gas burner and nestable inside of said decorative cover.

12. A portable gas burner as set forth in claim 11 wherein said base unit comprises a shell having a central aperture, a flat plate sealed to said ceramic fiber top and mounted on said shell over said central aperture, and leg means attached to said flat plate for providing a free standing burner for a campfire when removed from said shell.

13. A portable gas burner as set forth in claim 12 which further includes a fireplace grate for mounting over said burner and for supporting gas logs in a convertible fireplace unit.

14. A portable gas burner as set forth in claim 1 which further includes a set of lightweight insulating reinforced ceramic fiber fireplace logs for stacking over said gas burner on said fireplace grate.

15. A portable gas burner as set forth in claim 1 which further includes a set of lightweight insulating reinforced ceramic fiber camp fire logs for stacking over said gas burner for providing a gas camp fire.

16. An indoor/outdoor portable gas burner for use as an open campfire or as a fireplace burner, comprising:

a lightweight insulating reinforced ceramic fiber (RCF) top formed with an open face, a base unit connected below said ceramic fiber top to form a gas manifold therebetween, a pattern of burner jet extending through the top of said insulating ceramic fiber top forming an open face gas burner with a pattern of free flames, leg means attached to said base unit for providing a support for said open face gas burner, connecting means coupled into the gas manifold of said gas burner for connecting an air gas mixture into said open face gas burner, a manually operable gas valve coupled to said connection means and having a quick connect outlet for connection to a source of gas, and said lightweight insulating reinforced ceramic fiber top forming an insulating shield to prevent radiant heat from said gas flames from heating said base unit, said leg means and said manually operable gas valve so that said gas burner is quickly disconnectable from the source of gas for transport or storage.

17. An indoor/outdoor burner as set forth in claim 16 wherein said leg means comprises a cylindrical leg support for protecting said gas valve means when said gas burner is built-in to be surrounded by a mound of rock-shaped material.

18. An indoor/outdoor burner as set forth in claim 16 wherein said base unit is connected to said lightweight insulating reinforced ceramic fiber top by adhesive means.

* * * * *